US006252342B1

(12) United States Patent
Lee et al.

(10) Patent No.: US 6,252,342 B1
(45) Date of Patent: Jun. 26, 2001

(54) IMPREGNATED CATHODE STRUCTURE FOR A CRT AND ITS MANUFACTURING METHOD

(75) Inventors: Seung Yul Lee, Kyungsangbuk-do; Ji Hong Lee, Daegu-si; Jae Dong Park, Kyungsangbuk-do, all of (KR)

(73) Assignee: Orion Electric Co., Ltd., Kyungsangbuk-Do (KR)

( * ) Notice: Subject to any disclaimer, the term of this patent is extended or adjusted under 35 U.S.C. 154(b) by 0 days.

(21) Appl. No.: 09/200,193

(22) Filed: Nov. 25, 1998

(30) Foreign Application Priority Data

Nov. 29, 1997 (KR) ..... 97-64860
Nov. 9, 1998 (KR) ..... 98-47786

(51) Int. Cl.[7] ..... H01J 1/28; H01J 9/04

(52) U.S. Cl. ..... 313/346 DC; 445/51

(58) Field of Search ..... 313/346 DC; 445/51, 445/50

(56) References Cited

U.S. PATENT DOCUMENTS 3,110,081 * 11/1963 Hendriks ..... 445/51
3,842,309 * 10/1974 Van Stratum et al. ..... 445/51
3,906,269 * 9/1975 Tanji ..... 313/483
5,294,399 * 3/1994 Akiyama ..... 419/8

* cited by examiner

*Primary Examiner*—Kenneth J. Ramsey
(74) *Attorney, Agent, or Firm*—Notaro & Michalos P.C.

(57) ABSTRACT

Disclosed is an impregnated cathode structure for a cathode ray tube and its manufacturing method, in which electron emitting material impregnated in a pellet is free from an effect of the welding heat generated when the pellet is secured to a heater sleeve. The impregnated cathode structure has a pellet assembly including a pellet and a pellet fixing sheet. The pellet is attached to a first surface of the pellet fixing sheet, which has a plurality of protuberances. The pellet is manufactured by pressing and sintering, and impregnating electron emitting material into the porous of the pellet. The pellet sleeve is inserted in and welded to a heater sleeve. A heater sleeve is welded to a second surface of the pellet fixing sheet, which is opposite to the first surface.

7 Claims, 7 Drawing Sheets

IMPREGNATED CATHODE STRUCTURE FOR A CRT AND ITS MANUFACTURING METHOD

FIELD OF THE INVENTION

The present invention relates to an impregnated cathode structure for a cathode-ray tube (CRT) and its manufacturing method, and more particularly to an impregnated cathode structure for a cathode-ray tube (CRT) which can prevent the deterioration of impregnated electron emitting material due to an effect of the welding heat for securing a pellet to a heater sleeve, and a method of easily manufacturing it.

BACKGROUND OF THE INVENTION

In general, an impregnated cathode for a CRT is manufactured by pressing tungsten powder into a pellet having a certain porosity, sintering the pellet, impregnating electron emitting material into the sintered pellet, and securing the pellet to a pellet sleeve and a heater sleeve, generally using a laser or an electric-resistance welding method or a brazing method. Therefore, since the pellet is secured to the heater sleeve by the welding, the impregnated electron emitting material is deteriorated due to an effect of the welding heat and hot electron emitting decreases, or hot electron is not produced from the cathode, thus deteriorating the whole characteristics of the CRT.

FIGS. 1 to 5 illustrate the improved prior art cathode structures to solve or alleviate the above problems or the like.

Referring to FIG. 1, a pellet cup 12, which is secured to a heater sleeve 13, has plural projection parts on its base part in an impregnated cathode structure, which is disclosed by Japanese patent laid-open publication No. 61227342 A. Thus, a substantial contact area with a cathode pellet 11 can be kept large even when a pellet cup 12 generates thermal deformation. Thereby, the fitting condition between the cathode pellet 11 and the pellet cup 12 can be stabilized to realize an impregnated cathode having stable electron emitting property at its high operating temperature and thereby improve the temperature property of a cathode.

In FIG. 2, a pellet 21 of an impregnated cathode structure, which is disclosed by Japanese patent laid-open publication No. 55143743 A, is obtained by cutting a porous tungsten rod which is sintered after compressing tungsten powder. A pellet assembly is formed by securing tungsten wire mesh 22 tightly through Mo-Ru brazing material 23 mixed with an organic binder to the pellet 21. Then the outside portion is removed such that the surface portion of the mesh 22 is exposed. Thereafter it is heated under reductive ambient to perform the brazing work. Then said substrate is cut to predetermined shape to produce a cathode member which is welded through resistor welding with a heater sleeve, which is not illustrated herein. This structure can achieve good soldering and stable characteristics.

FIG. 3*a* illustrates the prior art impregnated cathode structure for a CRT, which is disclosed on Japanese patent laid-open publication No. 03155020 and wherein an intermetallic compound bond layer 33 with a main ingredient of Al is formed between a pellet 31 and the bottom surface of a cup 32 to firmly bond them together, then the cup 32 is secured to the upper surface of the a heater sleeve 34. This provides an impregnated cathode structure showing stabilized electron emitting characteristic even after a long period of use. In FIG. 3*b*, the intermetallic compound bond layer 33 is formed by placing an aluminum foil 33' between the pellet 31 and the bottom surface of the cup 32 followed by heating in vacuum, thus having an advantage of a low manufacturing cost.

Referring to FIG. 4 disclosed on Japanese patent laid-open publication No. 60165021, many holes 42 are formed on a nickel substrate 43 and are impregnated with the alkaline earth carbonate. Furthermore, the alkaline earth carbonate may be spread on the electron emission layer 41 to such a thickness that coating resistance generates no trouble. In this way, even if the cathode is heated to high temperature during the sealing procedure of the cathode-ray tube in atmosphere, the nickel substrate 43 does not take much oxygen and the cathode-ray tube after completion stably bears high current density operation, thereby reproducing the images with high brightness and high precision.

In FIG. 5, which illustrates the prior art impregnated cathode structure disclosed by Japanese patent laid-open publication No. 60047331, brazing material 54 is applied to only the external section of a hollow cylindrical body 55 that is integratedly comprised with a cathode substrate 51. Since such structure does not require the sealing hole treatment near the central part in which the thickness of the cathode substrate 51 is smallest, the insufficient impregnation of electron emission material can be offset due to the intrusion of brazing material and a cathode with more homogeneous electron emission characteristics can be obtained. In addition, since a heater coil 53 is connected to the inner part of a sleeve 52 and the hollow cylindrical body 55, thermal conduction efficiency is improved.

However, the above conventional impregnated cathode structures still employ a welding method such as a laser welding method or a brazing method in securing the pellet to a pellet sleeve and a heater sleeve. Therefore, the above conventional impregnated cathode structures have not completely overcome the problem yet that the impregnated electron emitting material is deteriorated due to an effect of the welding heat, which thus causes deterioration of the whole characteristics of the CRT.

SUMMARY OF THE INVENTION

The present invention has been made to overcome the above described problems of the prior arts, and accordingly it is an object of the present invention to provide an impregnated cathode structure in which electron emitting material impregnated in a pellet is free from an effect of the welding heat generated when the pellet is secured to a pellet sleeve and a heater sleeve.

It is another object of the present invention to provide a methode for manufacturing the impregnated cathode structure in which electron emitting material impregnated in a pellet is free from an effect of the welding heat, through a simple process.

To achieve the above objects, the present invention provides an impregnated cathode structure for a cathode ray tube, the impregnated cathode structure comprising: a pellet assembly including a pellet and a pellet fixing sheet, the pellet being attached to a first surface of the pellet fixing sheet, the first surface having a plurality of protuberances, the pellet being manufactured by pressing and sintering tungsten powder, and being impregnated by electron emitting material; a pellet sleeve in which the pellet assembly is inserted and welded with the heater sleeve; and a heater sleeve welded to a second surface of the pellet fixing sheet, the second surface being opposite to the first surface.

Preferably, the pellet fixing sheet is a Molybdenum sheet with a thickness of 48 to 52 m and has pores and protuberance, the pellet fixing sheet being fixed to the upper side of heater sleeve.

The present invention also provides a method for manufacturing an impregnated cathode structure, the method comprising the steps of:

(1) manufacturing a pellet assembly including a pellet and a pellet fixing sheet, the pellet being attached to a first surface of the pellet fixing sheet, the first surface having a plurality of protuberances, the pellet being manufactured by pressing and sintering, and being impregnated by electron emitting material;

(2) welding the pellet assembly to a heater sleeve. It is preferred that the step 1 comprises the steps of:

(a) performing blanking to a fixing sheet material having the protuberances formed on a surface of the fixing sheet material so as to make the pellet fixing sheet, the surface of the fixing sheet material being the first surface of the pellet fixing sheet;

(b) pressing the tungsten powder by the first surface of the pellet fixing sheet to thereby attach a pellet to the first surface of the pellet fixing sheet, the tungsten powder being the pellet attached with sheet; and (c) impregnating electron emitting material into porous of the pellet.

The steps a and b are performed through a single continuous press working by a blanking and pressing punch cooperating with a blanking and pressing die. More preferably, the step 2 comprises the steps of:

(d) inserting the pellet assembly into the pellet sleeve;

(e) inserting the heater sleeve in a lower end of the pellet sleeve so that an upper surface of the heater sleeve comes into contact with a second surface of the pellet fixing sheet, the second surface being opposite to the first surface; and (f) fixing the pellet assembly to the heater sleeve by laser welding.

The protuberances may be formed by a chemical method such as an etching or a mechanical method such as burring and louvering.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the attached drawings.

Figure 1:
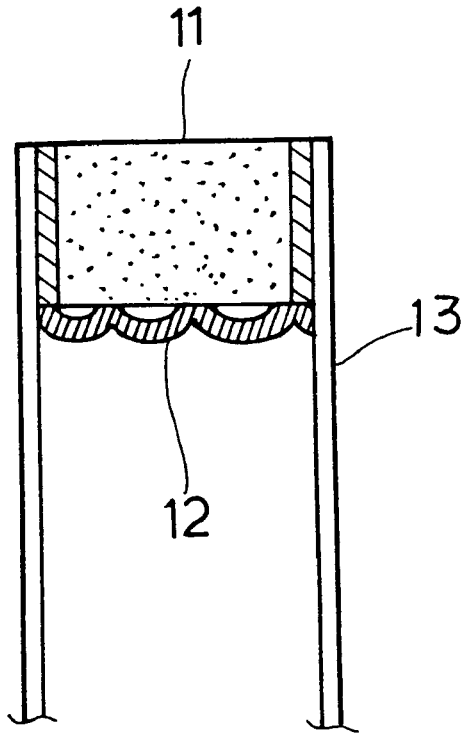
FIG. 1 is a sectional view of a conventional impregnated cathode structure.
Figure 2:
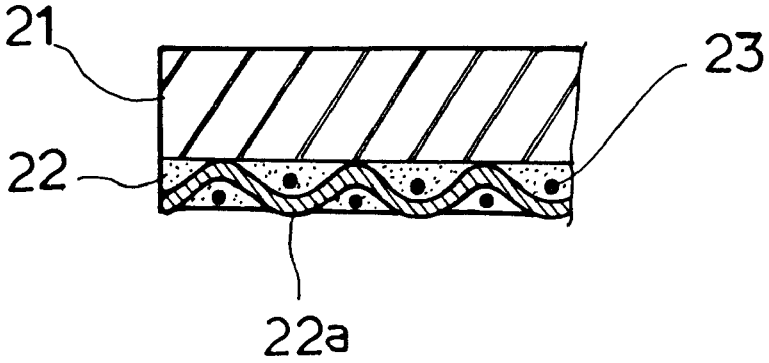
FIG. 2 is a sectional view of a pellet assembly of another conventional impregnated cathode structure.
Figure 3A:
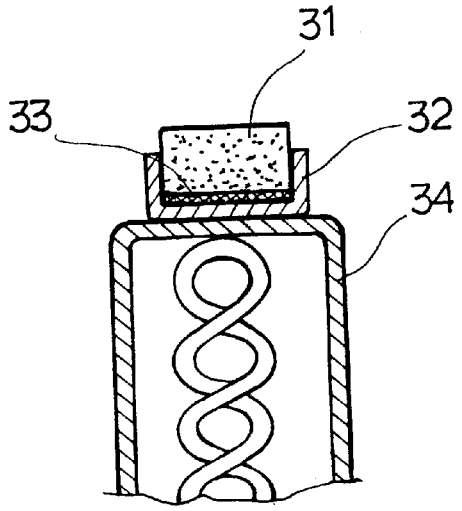
FIGS. 3*a* and 3*b* are sectional views for showing the structure and the manufacturing method of a pellet assembly of another impregnated cathode structure.
Figure 3B:
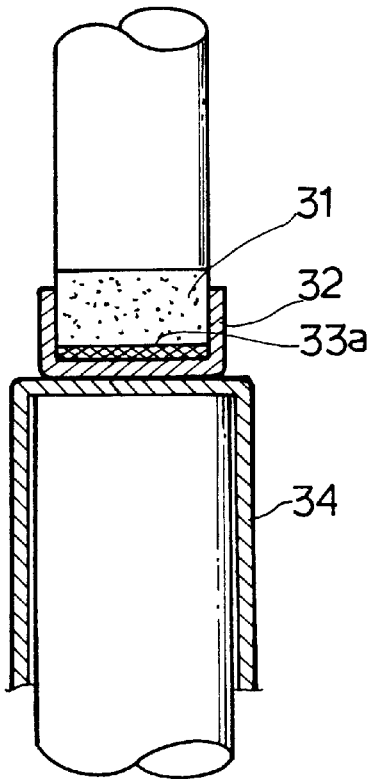
Figure 4:
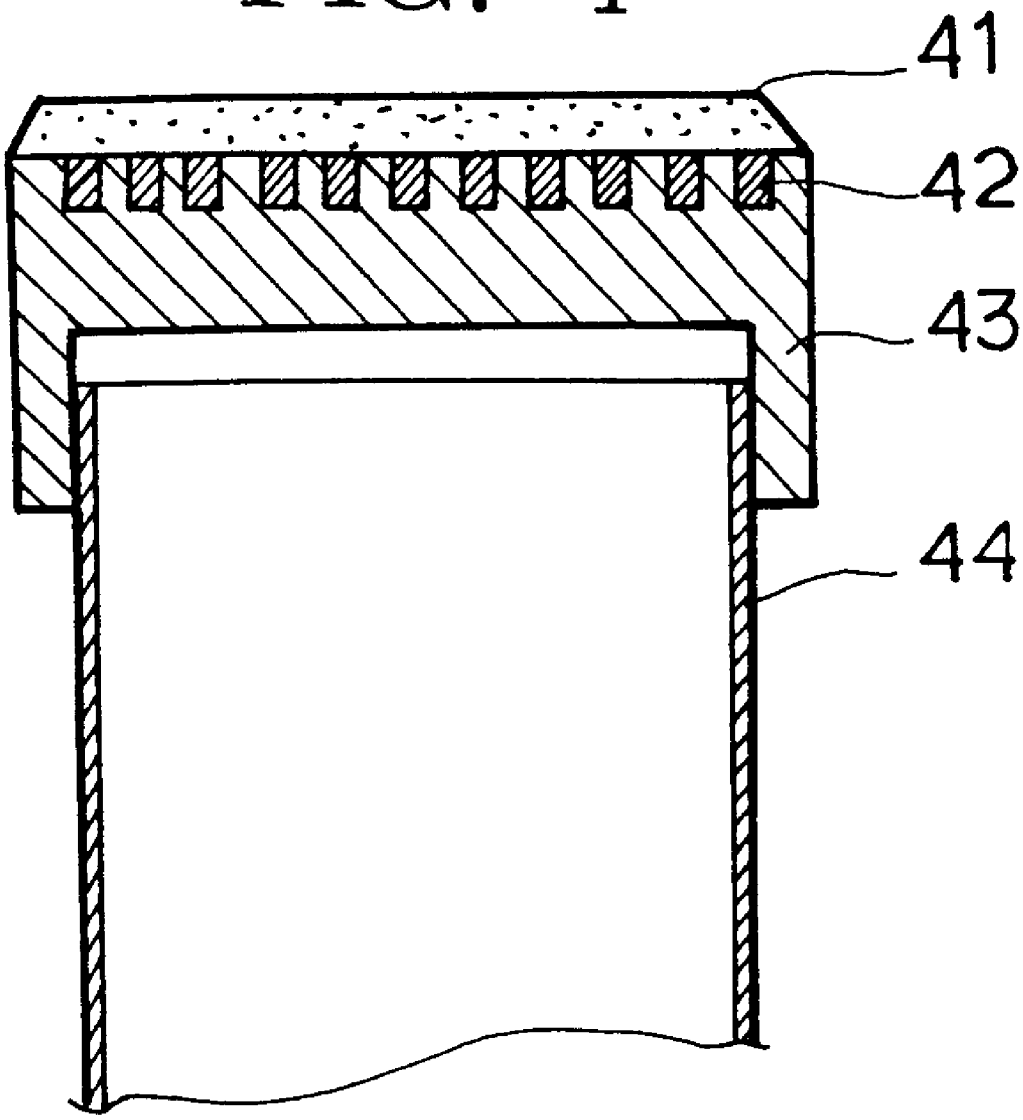
FIGS. 4 and 5 are sectional views of further conventional impregnated cathode structures.
Figure 5:
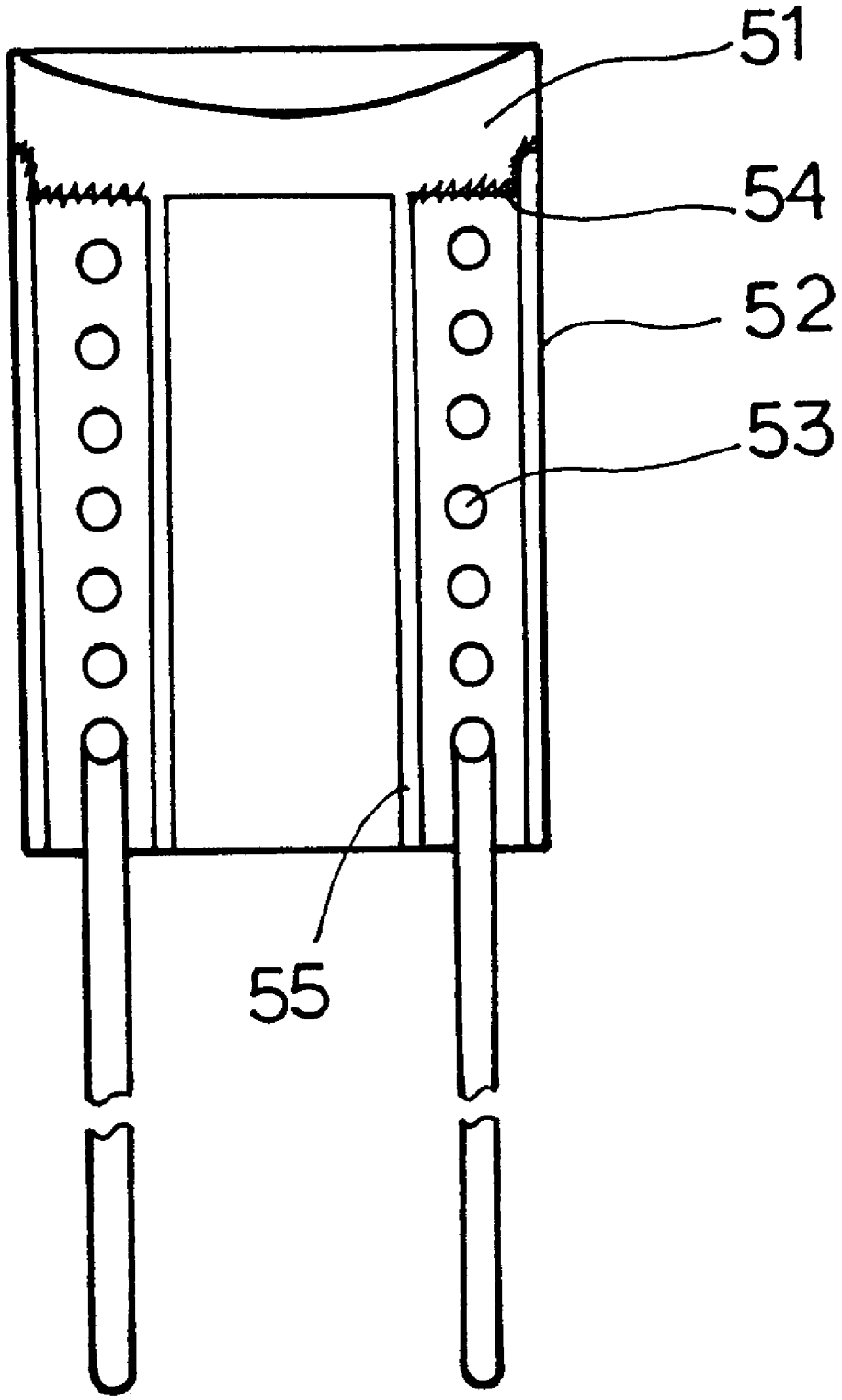
Figure 6:
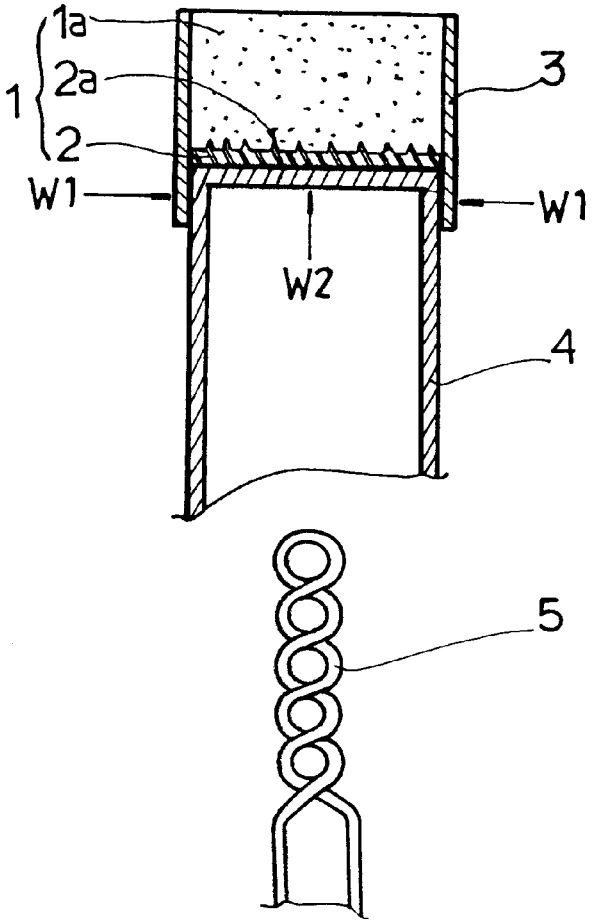
FIG. 6 is a sectional view of an impregnated cathode structure according to an embodiment of the present invention.
Figure 7:
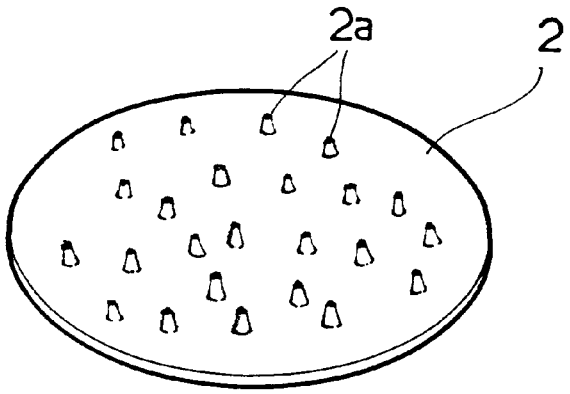
FIG. 7 is a perspective view of a pellet fixing sheet employed in the impregnated cathode structure shown in FIG. 6.

FIG. 6 is a sectional view of an impregnated cathode structure according to an embodiment of the present invention, and FIG. 7 is a perspective view of a pellet fixing sheet employed in the impregnated cathode structure shown in FIG. 6.

Referring to FIG. 6, the impregnated cathode structure according to an embodiment of the present invention includes a pellet assembly 1, a pellet sleeve 3, and a heater sleeve 4. The pellet assembly 1 includes a pellet 1*a* and a pellet fixing sheet 2. The pellet 1*a* is attached to an upper surface of the pellet fixing sheet 2 at which a serration or a plurality of protuberances 2*a* are formed. The pellet assembly 1 is inserted in the pellet sleeve 3 and welded to the heater sleeve 4 at a first welding point WI of the side wall of the pellet sleeve 3. The lower surface of the pellet fixing sheet 2 is welded at a second welding point W2 to the upper surface of the heater sleeve 4 fitted in the lower end of the pellet sleeve 3.

The pellet 1*a* is manufactured by pressing and sintering tungsten powder, and being impregnated by electron emitting material. In the manufacturing method of the present invention, which will be described below in detail, the electron emitting material is impregnated after the pellet assembly 1 is formed.

Preferably, the pellet fixing sheet 2 may be a Molybdenum sheet with a thickness of 48 to 52 m and may have fine pores (not shown) which may be formed at each of the protuberances 2*a*. That is, when the protuberances 2*a*, which may be formed by a chemical method such as an etching or a mechanical method such as a burring and louvering, the pores are formed at the protuberances 2*a*. The pores also achieve the object of the present invention. In other words, the tungsten powder is filled in the press machine's pores to be pressed with sheet and sintered, thereby achieving firm attachment between the pellet fixing sheet 2 and the 1*a*. When the protuberances 2*a* are formed with inclination by louvering, more firm attachment between the pellet fixing sheet 2 and the pellet 1*a* is secured.

In the impregnated cathode structure according to an embodiment of the present invention as constructed above, the pellet assembly 1 is inserted in and fixed to the pellet sleeve 3 mainly by a laser welding at the first welding point WI of the side wall of the pellet sleeve 3. The lower surface of the pellet fixing sheet 2 is fixed to the upper surface of the heater sleeve 4 fitted in the lower end of the pellet sleeve 3, mainly by a laser welding at the second welding point W2. Therefore, the pellet 1*a* and the impregnated electron emitting material in the pellet 1*a* are not directly put into the effect of the laser welding, so that the electron emitting characteristic of the impregnated electron emitting material and the cathode characteristics are prevented from deterioration In manufacturing the impregnated cathode structure as constructed above, although the pellet fixing sheet 2 may be firstly formed as shown in FIG. 7 and then be pressed together with the tungsten powder to form an integrated pellet assembly 1, the pellet assembly 1 may be formed also by pressing a fixing sheet material 2*b* on the pellet 1*a* simultaneously with blanking as shown in FIGS. 8*a* to 8*c* according to other embodiments of the present invention.

Figure 8A:
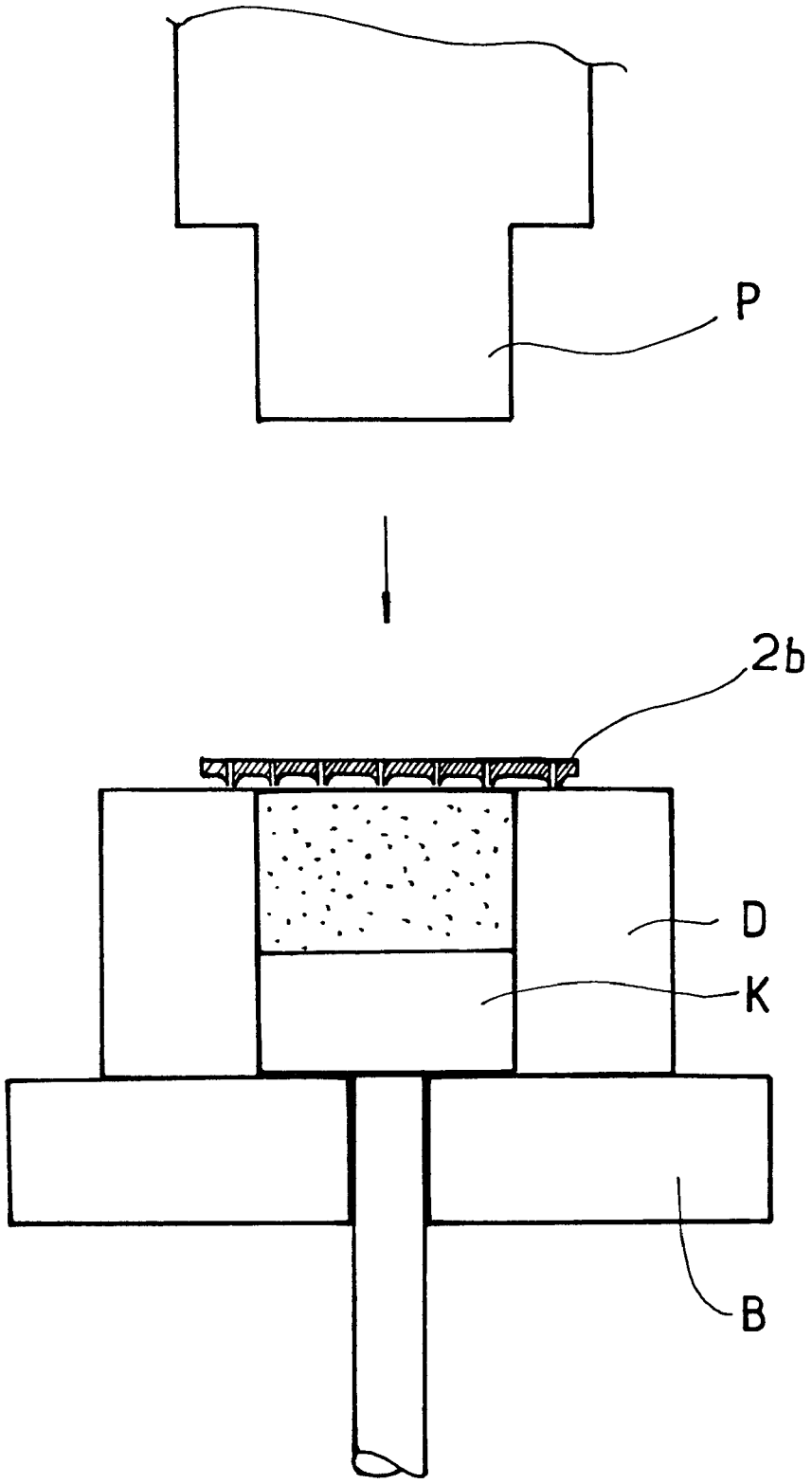
FIGS. 8*a* to 8*c* are views for showing steps of manufacturing the impregnated cathode structure shown in FIG. 6.
Figure 8B:
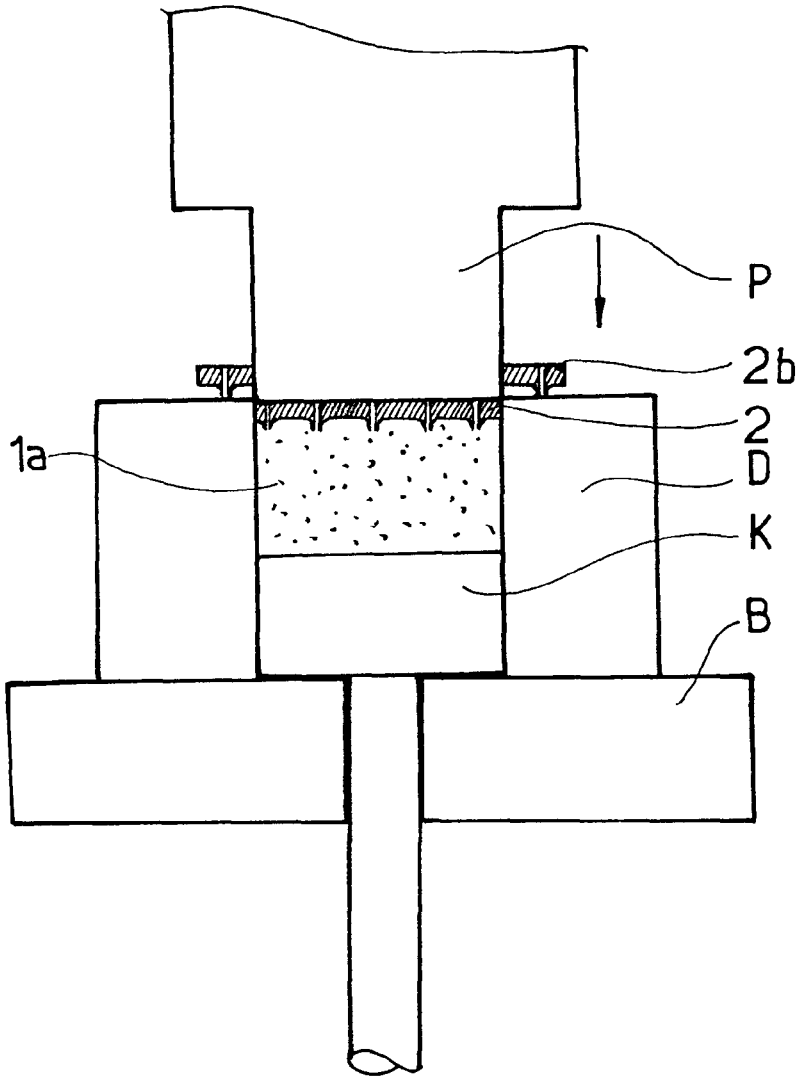
Figure 8C:
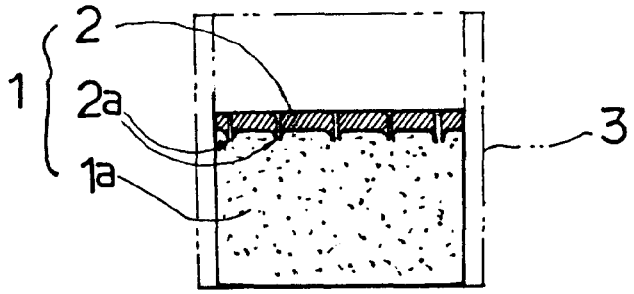

FIGS. 8*a* to 8*c* are views for showing this method for manufacturing the impregnated cathode structure, in which FIG. 8*a* shows a step that tungsten powder is filled in a punch receiving hole of a blanking and pressing die D and the fixing sheet material 2*b* of the pellet fixing sheet 2 is loaded on the blanking and pressing die D while a blanking and pressing punch P is open, FIG. 8*b* shows a step that the pellet fixing sheet 2 has been manufactured by blanking and the tungsten powder is pressed to have a certain porosity, and FIG. 8*c* shows a sectional view of a pellet assembly 1 in which the pellet 1*a* is attached to the pellet fixing sheet 2 through the above process.

Preferably, the fixing sheet material 2*b* of the pellet fixing sheet 2 may be a Molybdenum sheet with a thickness of 48 to 52 m and may have a plurality of protuberances 2*a* formed by a chemical method such as an etching or a mechanical method such as a burring and louvering.

To give more detailed description of the above method for manufacturing the impregnated cathode structure, tungsten powder is firstly filled in the punch receiving hole of the blanking and pressing die D as shown in FIG. 8*a*, and the fixing sheet material 2*b* is loaded on the blanking and pressing die D in such a manner that the lower surface of the fixing sheet material 2*b* has the protuberances 2*a*.

Thereafter, the blanking and pressing punch P disposed above is lowered down to perform blanking the fixing sheet material 2*b* into the pellet fixing sheet 2 by cooperating with the blanking and pressing die D, as shown in FIG. 8*b* (blanking step). Then, the blanking and pressing punch P continues to go down with pressing the tungsten powder filled in the punch receiving hole of the blanking and pressing die D. When the blanking and pressing punch P has reached the bottom dead point, the tungsten powder has been compressed to have a certain porosity with being attached to the lower surface of the fixing sheet material 2*b* (pressing and attaching step). When the blanking and pressing punch P and the knock-out punch K are elevated, the completed pellet assembly 1 as shown in FIG. 8*c* can be unloaded from the punch receiving hole. Then, the knock-out punch K is lowered down for another process for forming another pellet assembly 1.

The pellet assembly 1 formed through the above steps is then sintered and impregnated with electron emitting material by the conventional method. Thereafter, as shown in FIG. 6, the pellet assembly 1 is inserted in the pellet sleeve 3, and the heater sleeve 4 is inserted in the lower end of the pellet sleeve 3 so that the upper surface of the heater sleeve 4 comes into contact with the lower surface of the pellet fixing sheet 2 of the pellet assembly 1 inserted in the pellet sleeve 3. Then, the pellet assembly 1 is fixed to the pellet sleeve 3 at the first welding point W1 and to the heater sleeve 4 at the second welding point W2 by laser welding.

The pellet assembly 1 manufactured through this process reduces its manufacturing cost because the blanking step and the pressing and attaching step can be performed by a single press working.

In the impregnated cathode structure according to the present invention as described above, the pellet fixing sheet 2 attached under the pellet 1*a* eliminates an effect of the welding heat to thereby improve the electron emitting characteristic and the cathode characteristic. Further, in the above described method of manufacturing the impregnated cathode structure, the pellet assembly 1 can be manufactured with low expense and by easy labor because the blanking step and the pressing and attaching step can be performed concurrently by a single press working.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An impregnated cathode structure for a cathode ray tube, the impregnated cathode structure comprising:

a pellet assembly including a pellet and a pellet fixing sheet, the pellet being attached to a first surface of the pellet fixing sheet, the first surface of sheet having a plurality of protuberances, the pellet being manufactured by pressing and sintering tungsten powder, and being impregnated by electron emitting material;

a pellet sleeve in which the pellet assembly is inserted and welded; and a heater sleeve welded to a second surface of the pellet fixing sheet, the second surface being opposite to the first surface.

2. An impregnated cathode structure as claimed in claim 1, wherein the pellet fixing sheet is a Molybdenum sheet with a thickness of 48 to 52 m and has pores, the pellet fixing sheet being fixed to the heater sleeve by welding.

3. A method for manufacturing an impregnated cathode structure, the method comprising the steps of:

(1) manufacturing a pellet assembly including a pellet and a pellet fixing sheet, the pellet being attached to a first surface of the pellet fixing sheet, the first surface having a plurality of protuberances to be securely attached to the pellet, the pellet being manufactured by pressing and sintering the pellet, and being impregnated by electron emitting material;

(2) welding the pellet assembly to a pellet sleeve and a heater sleeve.

4. A method as claimed in claim 3, wherein the step 1 comprises the steps of:

(a) performing blanking to a fixing sheet material having the protuberances formed on a surface of the fixing sheet material so as to make the pellet fixing sheet, the surface of the fixing sheet material being the first surface of the pellet fixing sheet;

(b) pressing the tungsten powder by the first surface of the pellet fixing sheet to thereby attach a pellet to the first surface of the pellet fixing sheet, the tungsten powder being formed into the pellet; and (c) impregnating electron emitting material into porous of the pellet.

5. A method as claimed in claim 4, wherein the steps a and b are performed through a single continuous press working by a blanking and pressing punch cooperated with a blanking and pressing die at the same time.

6. A method as claimed in claim 4, wherein the step 2 comprises the steps of:

(d) inserting the pellet assembly into the pellet sleeve;

(e) inserting the heater sleeve in a lower end of the pellet sleeve so that an upper surface of the heater sleeve comes into contact with a second surface of the pellet fixing sheet, the second surface being opposite to the first surface; and (f) fixing the pellet sleeve and the heater sleeve at a first welding point and to the heater sleeve at a second welding point by laser welding.

7. A method as claimed in claim 3, wherein the protuberances are formed by one method of a chemical method such as an etching and a mechanical method such as burring and louvering.

* * * * *